US010434811B2

(12) United States Patent
Folchini et al.

(10) Patent No.: US 10,434,811 B2
(45) Date of Patent: Oct. 8, 2019

(54) MEDICINE INFORMATION INSERT AND METHOD OF MAKING IT

(75) Inventors: Enrico Folchini, Rho (IT); Mario Casazza, Rivergaro (IT)

(73) Assignee: ESSENTRA PACKAGING S.R.L., Podenzano (Piacenza) (IT)

( * ) Notice: Subject to any disclaimer, the term of this patent is extended or adjusted under 35 U.S.C. 154(b) by 183 days.

(21) Appl. No.: 13/696,946

(22) PCT Filed: May 10, 2011

(86) PCT No.: PCT/IB2011/052054

§ 371 (c)(1),
(2), (4) Date: Nov. 8, 2012

(87) PCT Pub. No.: WO2011/141870

PCT Pub. Date: Nov. 17, 2011

(65) Prior Publication Data

US 2013/0056975 A1 Mar. 7, 2013

(30) Foreign Application Priority Data

May 11, 2010 (IT) ..... BO2010A0299

(51) Int. Cl.

| | |
|---|---|
| ***B42D 15/00*** | (2006.01) |
| ***B42D 5/00*** | (2006.01) |
| ***G09F 3/00*** | (2006.01) |

(52) U.S. Cl.

CPC ..... *B42D 5/00* (2013.01); *B42D 15/008* (2013.01); *G09F 3/0289* (2013.01); *Y10T 156/10* (2015.01); *Y10T 156/1049* (2015.01)

(58) Field of Classification Search

CPC ..... B42D 15/00; B42D 1/006

USPC ..... 270/32; 281/21.1

See application file for complete search history.

(56) References Cited

U.S. PATENT DOCUMENTS

| | | | | |
|---|---|---|---|---|
| 3,920,267 | A * | 11/1975 | Lyon, Jr. | 281/16 |
| 4,010,964 | A * | 3/1977 | Schechter | 283/56 |
| 4,053,150 | A * | 10/1977 | Lane | B65H 45/18 493/417 |
| 4,312,523 | A * | 1/1982 | Haines | 40/630 |
| 4,441,739 | A * | 4/1984 | Cluff et al. | 281/16 |
| 5,031,937 | A * | 7/1991 | Nellhaus | 283/52.1 |
| 5,405,127 | A * | 4/1995 | Welborn | B65H 45/18 270/21.1 |
| 5,667,210 | A | 9/1997 | Delise, Jr. | |

(Continued)

FOREIGN PATENT DOCUMENTS

| | | |
|---|---|---|
| EP | 0 900 671 | 3/1999 |
| EP | 1 818 301 | 8/2007 |

OTHER PUBLICATIONS

International Search Report dated Jul. 13, 2011 from counterpart application.

*Primary Examiner* — Patrick H Mackey
(74) *Attorney, Agent, or Firm* — Shuttleworth & Ingersoll, PLC; Timothy J. Klima

(57) ABSTRACT

A medicine information insert comprises a plurality of sheets made preferably of paper, each of which has at least one graphical representation relating to a medicine; the sheets are fixed together at a respective joining zone and before being inserted into the cartons containing the medicines are folded by multiple parallel folding, with the possibility of combining this with further crosswise (transversal) folding.

17 Claims, 2 Drawing Sheets

(56) References Cited

U.S. PATENT DOCUMENTS

| | | | | |
|---|---|---|---|---|
| 6,752,427 | B1 * | 6/2004 | Wilen | B42D 1/006 281/29 |
| 6,837,290 | B2 * | 1/2005 | Vijuk et al. | 156/356 |
| 6,964,413 | B2 * | 11/2005 | Vijuk | 270/39.06 |
| 6,983,932 | B2 * | 1/2006 | Denny | 270/52.09 |
| 7,018,499 | B2 * | 3/2006 | Furst et al. | 156/211 |
| 7,135,084 | B2 * | 11/2006 | Furst et al. | 156/211 |
| 2004/0209754 | A1 | 10/2004 | Mattila et al. | |
| 2005/0098934 | A1 * | 5/2005 | Denny | 270/1.01 |

* cited by examiner

MEDICINE INFORMATION INSERT AND METHOD OF MAKING IT

This application is the National Phase of International Application PCT/IB2011/052054 filed May 10, 2011 which designated the U.S. and that International Application was published under PCT Article 21(2) in English.

This application claims priority to Italian Patent Application No. BO2010A000299 filed May 11, 2010 and PCT Application No. PCT/IB2011/052054 filed May 10, 2011, which applications are incorporated by reference herein.

TECHNICAL FIELD

This invention relates to a medicine information insert.

More specifically, this invention relates to a medicine information insert commonly known as "patient information leaflet", containing full information about the medicine it accompanies.

BACKGROUND ART

As is known, a patient information leaflet consists of a sheet of paper, normally folded on itself several times so it fits easily into the medicine pack.

Generally speaking, current health regulations in different countries determine the information that must be provided in the leaflet to define the ingredients, doses and usage of the medicine.

For example, the following is printed on both sides of the patient information leaflet: the brand name (name of the drug), a brief description of the active ingredient and copyright information; the company that manufactures and/or distributes the drug, including details of how the company can be contacted; how the drug works and must be used, including warnings and precautions for its proper use; dosage and administration, when and how the drug should be taken, including possible results of overdosage or related problems; the expiry date and general warnings regarding the risks incurred if the drug is not used properly.

As mentioned above, the patient information leaflet consists of a single sheet of paper, precisely because this ensures that the user will have ready access to all the information about the medicine on a single piece of paper. That means none of the information about the drug will be lost because it is all on one sheet.

The size and number of folds of the patient information leaflet depend on the amount of information it contains and on the size of the medicine pack.

An example of an information insert is described in patent documents EP 0 900 671 and EP 1 818 301.

These documents describe an insert made from a single sheet which is suitably folded so it fits into a pack.

These information inserts, however, have one major drawback, due mainly to the limited amount of space available for all the information about the medicine.

To overcome this drawback, the information is printed in a very small font size so that as much information as possible can be squeezed into the available space.

This solution, however, in turn has the major disadvantage that the very small print is very difficult to read.

Patent document U.S. 2004/209754 describes an information item comprising a pair of information items, that is, a first information item and a second information item which are folded and coupled to each other.

It should be noticed that one of the information items (either the first or the second) of the pair of information items is a sheet which is suitably folded and then coupled to the sheet constituting the other information item of the pair of information items.

Coupling is accomplished as a result of folding the sheets.

The first item normally addresses medical staff, while the second item addresses the patient.

In light of this, this information item does not overcome the drawbacks described above.

In this context, the technical purpose which forms the basis of the present invention is to propose a medicine information insert which overcomes the above mentioned drawbacks of the prior art and which facilitates reading of the leaflet's contents in view also of recent European regulations on this subject, which require leaflet font size to be enlarged in order to improve legibility. Obviously, that would entail printing the information on a larger sheet of paper.

In effect, the solution to the problem of font size might be that of using sheets of paper which are much larger than those commonly and normally used today.

That would mean, in some cases, having to change existing printing technology (to use printing cylinders with larger transversal dimensions: printing width).

That would actually be less of a problem than having to also change sheet folding technology (where the sheet is folded, as is currently the case, so it will fit into the carton containing the medicine). In effect, that problem, irrespective of whether the technology for folding very large sheets currently exists or not, would involve a series of onerous investments both for companies (converters) who print and fold the information leaflets and for pharmaceutical companies themselves, where the latter receive the printed sheets from external sources and fold them using their in-house medicine packaging machinery.

In particular, this invention has for an aim to provide a medicine information insert able to provide sufficient space to contain all the necessary information about the medicine, even when the font size used is not particularly small.

Another aim of the invention is to provide a medicine information insert composed of a single body in order to prevent parts, if any, of the insert from being involuntarily separated.

DISCLOSURE OF THE INVENTION

The technical purpose and aims specified are substantially achieved by a medicine information insert comprising the technical features described herein.

Moreover, the information insert according to this invention has further advantageous technical features which, by way of non-exhaustive example can be summarized as follows:

possibility of having multi-language texts in the same information insert, divided into sections, but belonging to the same information insert;

possibility of having differently coloured pages to stress certain types of information rather than others;

possibility of dividing the information insert into separate parts to be kept by the patient, or delivered to the doctor or other drug prescribing agent as proof of purchase of the drug itself;

possibility of having the same information on different pages of the insert, numbered in sequence, so as to have repeated access to medicines without having to obtain additional medical prescriptions.

BRIEF DESCRIPTION OF THE DRAWINGS

Further features and advantages of this invention are more apparent in the description below of a preferred but nonexclusive and non-limiting embodiment of a medicine information insert as illustrated in the accompanying drawings, in which.

DETAILED DESCRIPTION OF THE PREFERRED EMBODIMENTS OF THE INVENTION

With reference to the accompanying drawings, the numeral 1 denotes in its entirety a medicine information insert according to this invention.

More specifically, this invention relates to an information insert 1 commonly known as "patient information leaflet", containing full information about the medicine it accompanies.

Figure 1:
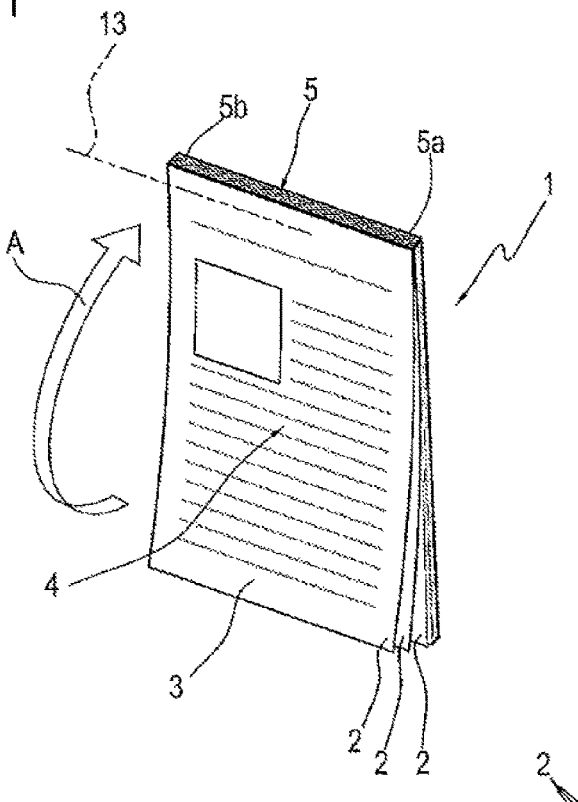
FIG. 1 is a perspective view of a medicine information insert according to this invention.

With reference in particular to FIG. 1, it should be noted that the insert 1 comprises a plurality of sheets 2 made preferably of paper.

The sheets 2 may be derived from reams of sheets which have been precut after printing or from sheets wound onto rolls, subsequently joined and cut to make up the information insert 1 laid out flat, that is to say, before being folded.

The sheets 2 are superposed on each other and each of them has a first, front surface 3, opposite a second, rear surface 6.

Each sheet 2 also presents at least one graphical representation 4 relating to a medicine, as illustrated schematically in the accompanying drawings.

The graphical representation 4 may comprise explanatory text, tables or drawings regarding the usage and doses of the medicine or any other necessary or useful information about the medicine.

The graphical representation 4 is preferably reproduced on the first surface 3 of each sheet 2. The graphical representation 4 might be reproduced also on the second surface 6 of each sheet 2.

Each sheet 2 of the information insert 1 may be printed both horizontally and vertically.

As mentioned above, the sheets 2 are superposed on each other and are all the same size and shape.

Preferably, as illustrated in the accompanying drawings, the sheets 2 are substantially quadrangular in shape, preferably rectangular, and are fixed together at a respective joining zone 5.

More specifically, it should be noticed that the sheets 2 are joined to each other in such a way that the large planar surfaces (3, 6) of the sheets 2 are superposed (that is to say, for example, it should be noticed that the underside face 6 of a first sheet 2 is superposed over the top face 3 of another second sheet 2, except for the last sheet 2).

More specifically, it should be noted that the sheets 2 are connected to form a block, as illustrated in the accompanying drawings.

It should be noted that the step of joining the sheets 2 to each other is performed before the insert 1 is folded; according to what is described above, the sheets 2 of the insert 1 (connected to each other) are folded simultaneously.

The joining zone 5 is located at a lateral edge of each sheet 2.

Depending on requirements, the lateral edge of the sheets 2 corresponding to the joining zone 5 may be either the long side or the short side 5*a* of the quadrilateral.

Therefore, the joining zone 5 may be any one of the lateral edges of the sheets 2 so as to make it possible to leaf through the sheets during use.

More specifically, the joining zone 5 may be obtained with different methods, described below, not exhaustively.

In accordance with a first method, the joining zone 5 may consist of a sealed portion 5*b* made by gluing the sheets 2 to each other.

According to a second method, the joining zone 5 may consist of a bound portion (not illustrated in the drawings) made by stitching together the sheets 2.

According to a third method, the joining zone 5 may be embodied by a fastening portion (also not illustrated) made using metal staples.

Figure 2:
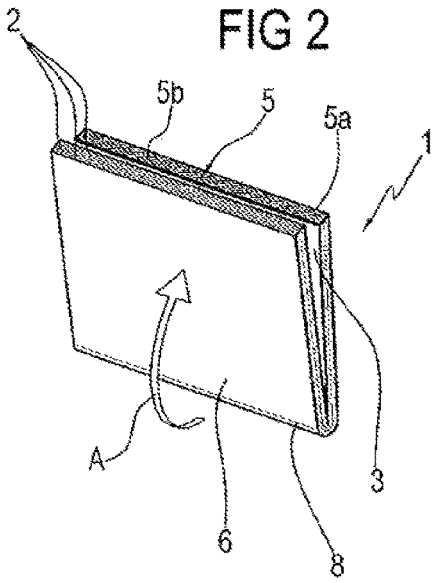
FIGS. 2 and 3 are perspective views showing the insert of FIG. 1 during respective sequential folding steps.
Figure 3:
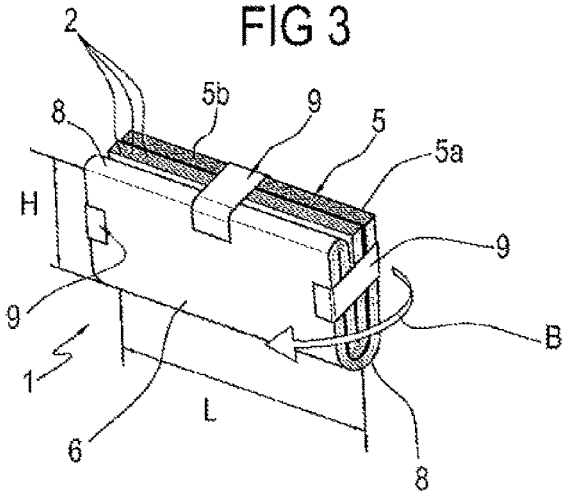

FIGS. 2 and 3 illustrate two steps of folding the insert 1 according to what is commonly referred to as "parallel folding", that is to say, folding the information insert 1 along multiple fold lines 8 parallel to the joining zone 5, that is, parallel to one of the sides 5*a* of the sheet 2.

The expression "fold lines 8 parallel to the joining zone 5" is used to mean that the fold lines 8 are substantially parallel to the line 13 identified by one of the sides 5*a* of the sheets 2, that is, the imaginary line 13 identified by the principal direction of extension of the joining zone 5.

The sheets 2 have at least one fold line 8 for folding the sheets 2 onto themselves into a condition of minimum dimensions.

As illustrated in FIG. 2, the fold line 8 allows the entire insert 1 to be folded by drawing the two half-parts of the insert 1 close to each other along the arrow "A".

Preferably, with reference to FIG. 3, there might be a further fold line 8 for folding all the sheets 2.

In other terms, the number of folds applied to the information insert 1, that is to say, the number of fold lines 8, 14 the insert 1 has at the end of folding operations depends on the requirements of the pharmaceutical company which, based on the original size of the information insert 1 before folding, specifies the maximum height dimension H of the insert 1 (FIG. 3).

That way, the entire insert 1 is folded into a variable number of parts according to the requirements of the pharmaceutical company to define the above mentioned condition of minimum dimensions.

By way of a non-limiting example, the insert 1 shown in FIG. 3 has been folded into four parts.

Figure 5:
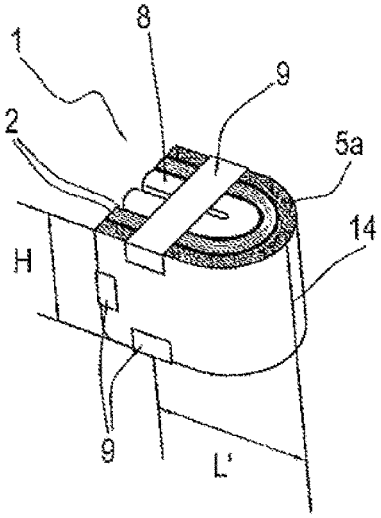
FIG. 5 is a perspective view of the insert of FIG. 1 folded into a further condition of minimum dimensions.

In this regard, it should be specified that the insert 1 can also be folded along a direction transversal to the imaginary line 13 identified by the principal direction of extension of the joining zone 5, that is, to the line 13 identified by one of the sides 5*a* of the sheets 2 (as illustrated in FIG. 5), in addition to the parallel folding, so as to also reduce the respective dimension defined by the joining zone 5 (thus, it should be noticed that $L' < L$).

The combination of transversal folding and parallel folding is referred to as "cross folding".

The expression "transversal folding" is used to mean that the fold lines 14 of the insert 1 is substantially at right angles to the line 13 identified by one of the sides 5*a* of the sheets 2, that is, the imaginary line 13 identified by the principal direction of extension of the joining zone 5.

The insert 1 of FIG. 5 is obtained by folding the insert 1 of FIG. 3 according to the arrow labelled B to obtain an alternative configuration of minimum dimensions, different from the one illustrated in FIG. 3.

Thus, the insert 1 can be folded any number of times and along any fold line, depending on the initial size of the insert itself and on its use requirements.

To keep the insert 1 in the required shape after it has been folded, the invention contemplates the provision of a fixing label 9, which may be made of plastic, paper-based or other material (poly laminates, laminates, etc.).

The fixing label 9 constrains the edges 5*b* and 5*c* of the sheets 2 of the folded insert 1 and keeps the folded insert 1 in the closed form, that is to say, it keeps the insert 1 in the configuration of minimum dimensions.

Alternatively to the above, the folded insert 1 can be held in the closed form by applying one or more spots of glue on the inside of the surfaces that come face to face during the last folding step.

These means for keeping the insert 1 in the closed position can also be applied to the insert 1 when it is folded by cross folding.

More specifically, the label/labels 9 or spots of glue may be applied on any one or more outer sides of the folded insert 1.

The insert 1 is folded and shaped according to the size of the pack 7 into which the insert 1 is placed and/or that of the medicine placed in the pack 7.

Figure 4:
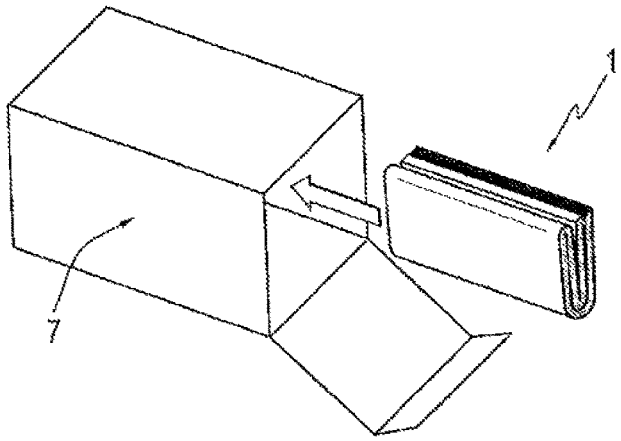
FIG. 4 is a perspective view of the insert folded into a condition of minimum dimensions, as illustrated in FIG. 3, and being inserted into a respective medicine pack.

As illustrated by way of example in FIG. 4, the insert 1, after being folded into the condition of minimum dimensions is also placed inside a pack 7 containing the medicine (the latter not being illustrated).

Advantageously, the graphical representation 4 reproduced on the sheets 2 relates to the medicine contained inside the pack 7.

Thus, the plurality of sheets 2 increases the amount of available space so that full information about the medicine can be provided.

Each sheet 2 therefore constitutes a page of the insert 1 which is made in accordance with the amount of information to be reproduced in the graphical representation 4.

Consequently, the graphical representations 4 can be printed in font sizes sufficiently large to be easily readable.

It should also be noticed that the joining zone 5 securely fixes the sheets 2 together, preventing them from being involuntarily separated and lost.

Figure 6:
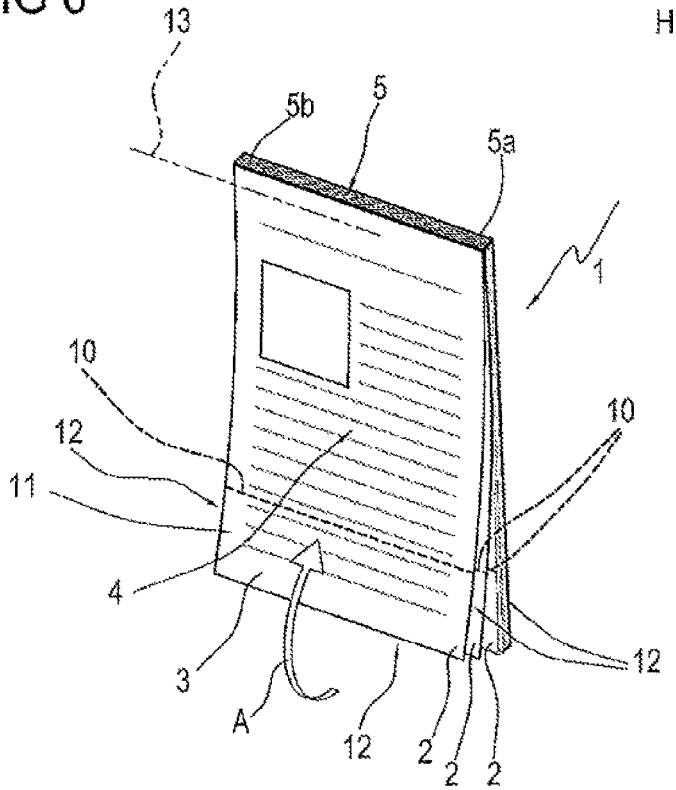
FIG. 6 is a perspective view of a medicine information insert according to another embodiment of this invention.

In another embodiment of the insert 1, illustrated in FIG. 6, one or more sheets 2 of the insert 1 comprise a sheet 2 portion 11 intended to be separated from the insert 1, that is to say, a separable portion 11.

The separable portion 11 is delimited by a portion 12 of the edges of the sheet 2 and by a pre-weakened tear line 10.

The term "pre-weakened tear line" is used to mean a profile, be it linear, curvilinear or comprising a piecewise linear curve, which forms a weakened zone of the sheet 2 designed to be torn to allow the portion 11 of the insert 1 to be separated.

The separable portion 11 may be located at any position on the sheet 2.

Advantageously, the portion 11 may contain information about the drug and useful for the patient and/or for the patient's doctor and/or also for a drug prescribing agent as proof of purchase of the drug itself.

The portion 11 may be separated from the insert 1 by applying a pulling force on the portion 11; the user can therefore advantageously separate the portion 11 conveniently and without using scissors.

The separable portion 11 may comprise information for identifying the drug (for example a bar code or an alphanumeric code); in light of this, the portion 11 may advantageously be used as proof of purchase of the drug.

According to another aspect of the invention, the graphical representations 4 on the plurality of sheets 2 of the insert 1 comprise information written in a plurality of languages and the graphical representation 4 on each sheet 2 comprises information written in the same language.

Advantageously, that makes it possible to have multilanguage texts in the same information insert 1, divided into different sheets 2 but all belonging to the same information insert 1.

Moreover, according to a further aspect of the invention, the insert 1 may comprise sheets 2 with a colour graphical representation 4. Advantageously, the colours can be used to classify the information on the sheets 2 according to importance or informative content.

Also, according to a yet further aspect, the insert 1 may comprise sheets 2 with the first, front surface 3 or the second, rear surface 6 coloured. That advantageously allows the contents of different sheets of the insert 1 to be separated (for example, the first sheets 2 may be coloured green, the central sheets may be coloured red and the last sheets may be coloured yellow).

Also, according to yet another aspect, the insert 1 comprises sheets 2 containing the same type of information with each sheet 2 numbered in sequence. This feature might be used to obtain the medicine on separate occasions without having to provide a medical prescription each time, as is the case at present.

In effect, according to this aspect, a sheet 2 of the insert 1 containing information identifying the drug can be torn off and delivered directly to the chemist to obtain the same drug.

The foregoing description defines a method for making a medicine information insert 1, comprising the following steps:

procuring a plurality of sheets 2, made preferably of paper, each having on it at least one graphical representation 4 relating to a medicine;

superposing the sheets 2 in such a way that the large planar surfaces 3, 6 of the sheets 2 are in contact with each other:

fixing together the sheets 2 at a respective joining zone 5.

Preferably, the joining zone 5 is located at an edge 5*a* of the sheets 2.

Preferably, the method comprises the further step of:

folding the sheets 2, after fixing them together, at least once along a fold line 8 parallel to one of the sides 5*a* of the sheets 2.

The method also comprises the step of:

again folding the sheets, after fixing them together and folding them at least once along a fold line 8 parallel to one of the sides 5*a* of the sheets 2, along another fold line 14 at right angles to that side 5*a* of the sheets 2.

Still more preferably, the method comprises a step of making in at least one of the sheets 2 a pre-weakened tear profile 10 for delimiting a sheet portion 11 which can be separated from the insert.

The invention claimed is:

1. A medicine package comprising:

a medicine information insert provided in an interior of the medicine package, the medicine information insert comprising:

a plurality of sheets, made of paper;

the sheets being fixed together at a respective joining zone;

the sheets being superposed over each other such that sheet surfaces constituting large planar surfaces of the sheets are in contact with each other, the joining zone being located at an edge of the sheets;

wherein each sheet of the insert comprises a fold line, the fold line of each sheet being superposed over fold lines of other sheets in the insert, thus forming a series of parallel fold lines parallel to the joining zone;

wherein the series of parallel fold lines parallel to the joining zone are suitable for folding the entirety of the unfolded insert onto itself through a single folding action about the superposed series of fold lines parallel to the joining zone without requiring any further folding;

wherein the entirety of the insert is an entire area of all the sheets of the insert;

wherein each sheet of the insert also comprises a series of parallel fold lines perpendicular to the joining zone.

2. The medicine package according to claim 1, wherein the sheets are substantially quadrangular in shape.

3. The medicine package according to the claim 1, wherein the sheets are superposed on each other and are substantially rectangular in shape; the joining zone being located at a short side of the sheets.

4. The medicine package according to the claim 1, wherein the sheets are superposed on each other and are substantially rectangular in shape; the joining zone being located at a long side of the sheets.

5. The medicine package according to claim 1, wherein the joining zone comprises a sealed portion including a glue gluing the sheets to each other.

6. The medicine package according to claim 1, wherein the joining zone comprises a bound portion including a stitching binding the sheets together.

7. The medicine package according to claim 1, wherein the joining zone comprises a fastening portion including metal staples fastening the sheets together.

8. The medicine package according to claim 1, wherein the at least one fold line is substantially parallel to a line identified by one of the sides of the sheets.

9. The medicine package according to claim 1, wherein the sheets have at least one fold line for folding the sheets onto themselves into a condition of minimum dimensions and which is substantially parallel to a line identified by one of the sides of the sheets, and at least one fold line which is substantially at right angles to the line identified by one of the sides of the sheets.

10. The medicine package according to claim 1, wherein the plurality of sheets comprise information written in a plurality of languages and each sheet comprises information written in the same language.

11. The medicine package according to claim 1, wherein at least one sheet comprises a colour graphical representation.

12. The medicine package according to claim 1, and further comprising at least one fixing label for keeping the insert in a folded state.

13. The medicine package according to claim 1, wherein at least one of the sheets comprises a portion which is separable from the insert and which is delimited by a portion of edges of the sheet and by a pre-weakened tear line.

14. The medicine package of claim 1, wherein each sheet of the insert comprises two sets of parallel fold lines parallel to the joining zone;

wherein a first set of parallel fold lines parallel to the joining zone is located a half-way along the length of the sheets and a second set of parallel fold lines parallel to the joining zone is located a quarter-way along the length of the sheets; and wherein the first set of parallel fold lines parallel to the joining zone and the second set of parallel fold lines parallel to the joining zone are suitable for folding the entire insert onto itself into a quarter of its original length through two folding actions without requiring any further folding.

15. A method for making a medicine package comprising:

providing a medicine information insert in an interior of the medicine package by:

procuring a plurality of sheets, made of paper;

superposing the sheets such that large planar surfaces of the sheets are in contact with each other;

fixing together the sheets at a respective joining zone, the joining zone being located at an edge of the sheets;

providing that each sheet of the insert comprises a fold line, the fold line of each sheet being superposed over fold lines of other sheets in the insert, thus forming a series of parallel fold lines parallel to the joining zone;

providing that the series of parallel fold lines parallel to the joining zone are suitable for folding the entirety of the unfolded insert onto itself through a single folding action about the superposed series of fold lines parallel to the joining zone without requiring any further folding to form the medicine information insert;

wherein the entirety of the insert is an entire area of all the sheets of the insert;

providing that each sheet of the insert with a series of parallel fold lines perpendicular to the joining zone;

folding the medicine information insert to form a folded medicine information insert;

inserting the folded medicine information insert into the medicine package.

16. The method according to claim 15, and further comprising:

folding the sheets, after fixing the sheets together, at least once along a fold line parallel to one of the sides of the sheets.

17. The method according to claim 16, and further comprising:

again folding the sheets, after fixing the sheets together and folding the sheets at least once along a fold line parallel to one of the sides of the sheets, along another fold line at right angles to the sides of the sheets.

* * * * *